United States Patent [19]

Kayser

[11] 4,023,346

[45] May 17, 1977

[54] WRIST WATCH WITH TIME DISPLAY CONTROL SWITCH

[76] Inventor: William M. Kayser, 6408 - 81st Ave. North, Minneapolis, Minn. 55445

[22] Filed: Apr. 1, 1976

[21] Appl. No.: 672,793

[52] U.S. Cl. ..... 58/50 R; 58/23 BA; 200/61.52

[51] Int. Cl.[2] ..... G04B 19/34

[58] Field of Search ..... 58/50 R, 85.5, 23 R, 58/23 BA; 200/61.45 R, 61.52, 61.11, DIG. 29

[56] References Cited

UNITED STATES PATENTS

| | | | |
|---|---|---|---|
| 3,466,045 | 9/1969 | Walton | 200/61.11 X |
| 3,871,170 | 3/1975 | Bergey | 58/50 R |
| 3,963,885 | 6/1976 | Brien | 58/50 R X |
| 3,974,638 | 8/1976 | Haber | 58/50 R |
| 3,983,690 | 10/1976 | McClintock | 58/50 R |

*Primary Examiner*—Ulysses Weldon
*Attorney, Agent, or Firm*—Frederick E. Lange

[57] ABSTRACT

A wristwatch of the digital type in which there is switch means including a movable member visible from the front of the watch and in which the movable member has to be manipulated deliberately into a predetermined position in order for the switch means to cause energization of the digital display on the watch. The watch is preferably provided with two transparent front walls between which the switch means is located. The movable member may take the form of a ball or other conductor member which is moved into engagement with spaced contacts when the watch is moved to a normal position for viewing and the ball is manipulated, while the watch is in that position, into engagement with the contacts. In one form of the invention, a mercury globule is used instead of a ball. Moreover, instead of having open contacts, the movable member may be a ball which is effective when manipulated to the predetermined position to engage the plunger of a precision snap switch and cause closure of the switch.

Any of several means are provided for requiring deliberate manipulation of the movable member to the predetermined position in the inner front wall. For example, in one form of the invention, there is a circular rim surrounding the contacts over which rim the movable member must be manipulated in order to engage the contacts. In another form of the invention, the rim has at least one opening therein of a size to allow manipulation of the ball or other movable member into the predetermined position. In still another form of the invention, the inner front surface is simply raised slightly around a predetermined position on the inner front wall.

10 Claims, 7 Drawing Figures

WRIST WATCH WITH TIME DISPLAY CONTROL SWITCH

BACKGROUND OF THE INVENTION

In recent years, the use of so-called digital wristwatches has greatly increased. These watches are characterized by the use of an electro-optic display employing light emitting diodes. A frequency standard in the form of a crystal oscillator acts through solid state electronic circuit dividers to control the light emitting diodes. A small dry cell battery is employed to energize the electrical elements.

While such wristwatches have the advantage of extreme accuracy in a digital display of the time, they have the drawback that in order to conserve the battery energy employed to energize the light emitting diodes, such watches are commonly provided with a switch which must be manipulated in some way to cause energization of the light emitting diodes. The common form of such a switch is a switch having an actuator projecting through the side of the case which must be pushed by the wearer to cause energization of the electro-optical display. The drawback to this arrangement is that it requires the use of the hand on the other arm than that on which the watch is worn, and if the wearer is in a situation where the other hand is not readily available, it becomes extremely difficult to determine what time it is. For example, if the wearer is carrying a number of packages, it is sometimes very difficult to manipulate the hand on which the watch is not being worn to a position in which this button can be closed.

As a result of this problem, various arrangements have been devised for enabling the electro-optical display to be energized by manipulation of the wrist on which the wristwatch is being worn. This usually involves an auxiliary switch which is closed by a predetermined arm movement. To guard against this auxiliary switch being turned on during normal movement of the arm on which the watch is mounted, provision is made for closing the switch only in the event of a predetermined abnormal movement off the arm. For example, one typical type of arrangement requires moving the arm between two positions within a predetermined period of time. Such arrangements are shown in the U.S. patents to Bergey Nos. 3,742,699, 3,823,550 and 3,871,170 and in the U.S. patent to Yamauchi et al., No. 3,935,701. The arrangements shown in the Bergey patents referred to also include the use of a magnetic switch which is closed by manipulation of the wrist to a position where there is a magnetic element being worn on the body such as in the belt buckle. Another arrangement proposed in at least the Bergey U.S. Pat. No. 3,742,699, is that of a diaphragm operated switch can be manipulated by movement of the arm on which the watch is being worn. Also, Bergey contemplates the use of a capacitance switch which is operated by movement of the arm to another portion of the body to change the capacitance.

All of these prior arrangements have the drawback of either increasing the complexity of the watch or of requiring a manipulation of the hand or arm which is not normal to reading of the watch. For example, those arrangements which require the movement of the wrist between two positions within a predetermined period of time require the presence of two separate switches with electronic circuitry to determine the time between the closure of the two switches and to cause energization of the electro-optical display only if the two switches are closed within a predetermined period of time. This obviously introduces additional complications into a watch which already contains some very complicated electronic circuitry. Similarly, when the display is turned on by the change in capacitance, this again requires additional circuit elements because the change in capacitance by movement of the wrist into proximity with another portion of the body is relatively small. Furthermore, all of the actions outlined above, as pointed out previously, require movements which are not normal to reading a watch.

SUMMARY OF THE PRESENT INVENTION

The present invention is concerned with a wristwatch of the type employing an electro-optical time display in which a switching means is provided for turning on the optical display and this switching means is manipulated by movement of the wrist to a position close to that in which the watch is normally placed when being read. Furthermore, in order to prevent the watch from being accidentally turned on by a random movement of the arm, the switch is closed only when the watch is intentionally manipulated to move a movable member into a predetermined position.

It is further contemplated that the switch will be mounted between two spaced front walls of the watch. This makes it possible to observe the action of the switch if the walls are transparent so that the wearer can determine where the movable member is with respect to the desired location in which the switch is closed.

Specifically, it is contemplated that the switch contacts will be associated with the inner of two front walls and that some means will be provided for preventing the movable member from moving freely into engagement with the switch contacts. This means may take the form of a slight rim either partially or completely surrounding the switch contacts so that the movable member must be manipulated with respect to this barrier in order to be moved to the position in which the contacts are closed. The rim may have one or more openings therethrough through which the movable member can be moved to swtich closing position. The barrier which prevents movement of the movable member to the switch making position may also be nothing more than a slightly raised portion of the inner wall which prevents the movable member from moving to the switch making position without conscious manipulation.

The movable member may be either in the form of a conductive ball or other conductive member such as a globule of mercury. In such case, the conductive member electrically connects two spaced contacts when moved to the predetermined position. Or, the movable member may be simply a member which has sufficient mass that it is capable of actuating the actuator of a precision snap switch when the movable member is moved to the switch making position.

It is a very important feature common to all of the modifications of the invention that the position in which the wrist must be in in order to move the movable member into switch making position and thus turn on the optical display is one close to that normally assumed when it is desired to read the watch. Thus, no abnormal movements of the arm are required in order to read the watch.

Various other objects and features of the invention will be apparent fromm the accompanying specification, claims and drawing.

DETAILED DESCRIPTION OF PREFERRED EMBODIMENTS

Figure 1:
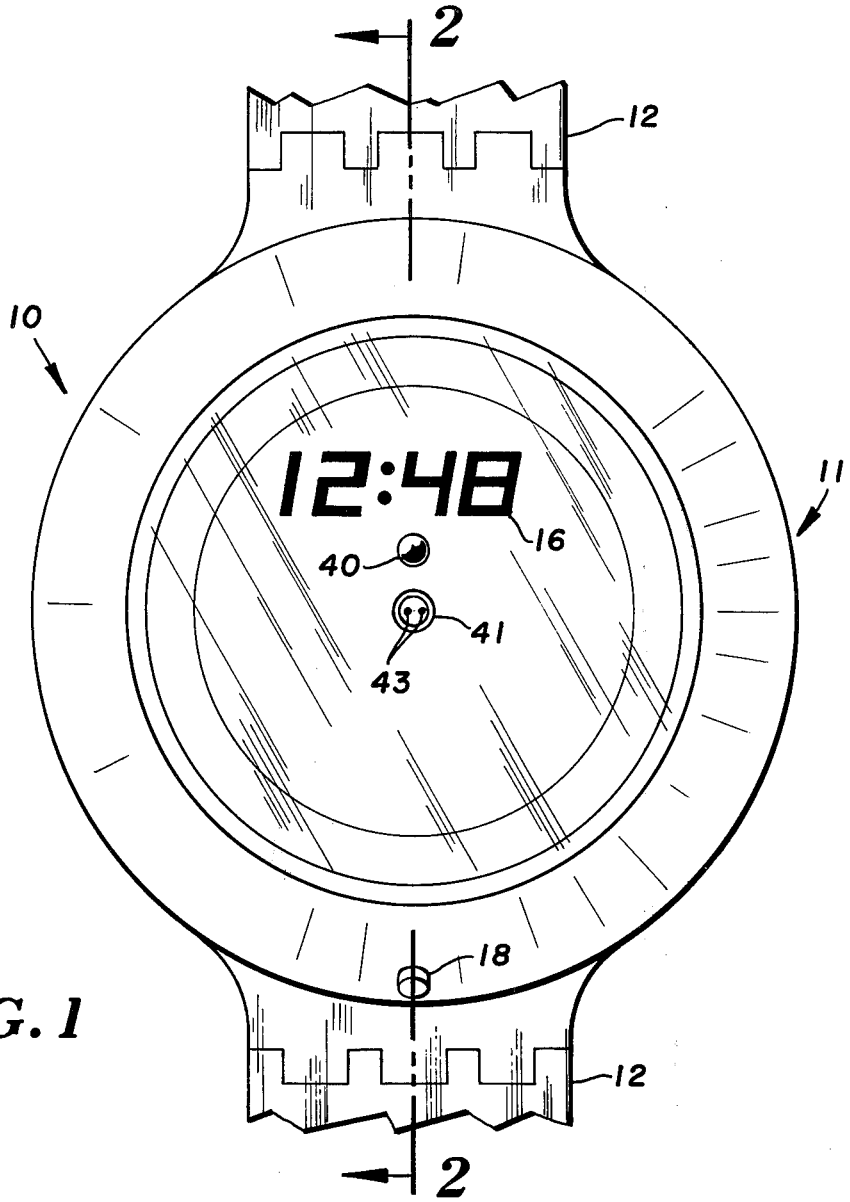
FIG. 1 is a front or plan view of a wristwatch constructed in accordance with the present invention.

Referring to FIG. 1 first, the novel watch of the present invention is generally indicated by the reference numeral 10. The watch is constructed to fit into a watch case 11 of a size suitable for wearing upon one's wrist. The case 11 is connected to a wristwatch bracelet 12, only a portion of which is shown, and which is designed in the conventional manner to encircle a wrist and support the watch 10 so that it can readily be moved to viewing position. Mounted on the case 11 in the manner to be described, and sealed thereto, are a plurality of display windows 14 and 15 (best shown in FIG. 2) through which time is displayed in digital form as indicated at 16. Mounted upon the case 11 is the conventional demand switch push button 18, by means of which display 16 may be energized when the wearer of the wristwatch 10 desires to ascertain the time by use of a demand button. As has been explained above and as will be explained in more detail below, the present invention contemplates means for actuating the display without operation of the button 18.

In normal operation, time is being continuously measured but is not displayed through the windows 14 and 15. In order to conserve battery energy, the display is energized only when demand button 18 is actuated or when the novel switch of my invention is operated for this purpose.

Figure 2:
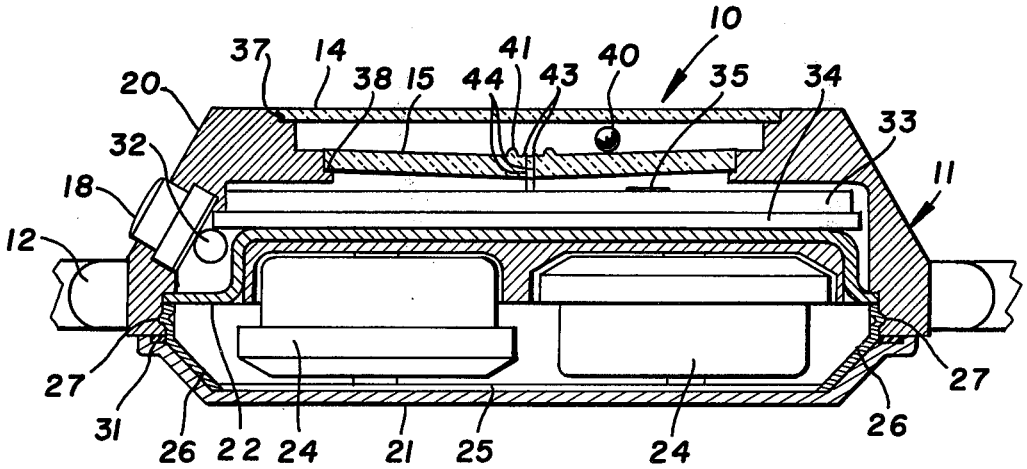
FIG. 2 is a cross sectional view of the watch, the section taken along the line 2—2 of FIG. 1.

Referring specifically to FIG. 2, the watch case 11 comprises a front portion 20, a removable back plate 21 and an inner cover 22. These three plates are preferably made from a suitable non-magnetic material. Between the inner cover 22 and the removable back plate 21 is a power supply in the form of a pair of dry cells 24 which may each be 1½ volt dry cells connected in series to produce an operating voltage of about 2½ to 3 volts DC. The back plate 21 preferably carries a suitable resilient connective bar 25 for connecting the dry cells 24 in series with each other. Back plate 21 further carries a plurality of mounting springs 26 with projections 27 which snap into corresponding recesses in the front portion 20 for ready attachment and removal of the back plate so that access may be gained to the battery cells 24. The back plate may be sealed by any suitable means such as an O-ring 31.

Switch button 18 is designed to cooperate with a switch 32 which may be a reed switch actuated by a magnet which is moved by the push button 18 into cooperative relationship with the reed switch 32. In this way, the switch 32 may be completely sealed.

Mounted above the inner cover 22 is a substrate 34 on which is disposed an electronic circuit generally indicated by the reference numeral 33. As part of this electronic circuit, it comprises a plurality of light emitting diodes generally indicated in FIG. 2 by the reference numeral 35. It is to be understood that suitable electrical connections are provided between the battery cells 24, the switch 32 and the various components of the electronic circuit 33. These connections will be discussed in somewhat more detail in connection with FIG. 6.

Conventional means is provided for setting the watch initially to the desired time. Since such setting means is conventional with digital type watches and forms no part of the present invention, it has not been shown. Similarly, another switch may be provided for displaying the month and day. Since this is also old in the art and my invention is primarily concerned with the display of the time, this additional switch has not been shown.

The watch as described above is not new as far as the present invention is concerned. It has been described merely to illustrate a typical watch of the digital type with which my invention can be associated. Referring now to the novel features of the present invention, the front portion 20 of the watch is provided with two annular shoulders 37 and 38. The annular shoulder 37 is located adjacent the front of the watch and may be of a somewhat larger diameter than the shoulder 38 which is located inwardly closely adjacent to the electronic circuit 34. Mounted within the annular shoulder 37 is the display window 14 which is preferably a clear window and readily transparent. This window may be formed of glass or any other suitable transparent material of the type commonly employed in watch crystals. Mounted within the annular shoulder 38 is a second window 15. This window 15 is, however, of unique construction in a number of ways. In the first place, as is conventional, at least the portion of window 15 overlying the light emitting diodes 35 should be formed of a suitable filter material of a deep red color which transmits most of the light from the light emitting diodes. Light from these diodes is typically in the wave length of approximately 6500 Angstroms. Such a window may be formed of a pink ruby coated on the inside with a red dyed clear epoxy paint. Both the windows 14 and 15 are sealed to the front portion 20 of the watch. This is important in connection with windown 14 since it is desired to have a liquid and airtight seal at this point to prevent the access of air or moisture into the space beneath the window 14. It is also desirable, however, in connection with window 15 so that the space between the windows can be evacuated, as will be pointed out below.

The window 15, as will be evident from FIG. 2, slopes toward the center. Mounted upon the window 15 in rolling engagement therewith is a conductive ball 40 which, when the watch is held in the position shown in FIG. 2, tends to roll towards the center of the window 15 by reason of the slope just discussed. Surrounding the center of the window, however, is an annular rim 41 which may be formed of the same material as the window 15. Thus, in order to move the ball 40 into the central position of the window 15, it is necessary to maneuver the ball 14 over the rim 41. As pointed out previously, this is done to insure the necessity of deliberate action upon the part of the wearer of the watch in order to place the ball in the central contact making position.

A pair of contacts 43 is located within the recess formed by rim 41 and projects slightly above the upper or outer surface of window 15. These contacts are designed to be engaged by the ball 40 when the ball is located in the central position of the window 15 resting within the recess formed by the rim 41. The two contacts 43 are connected by leads 44 to the electronic circuit 33 as will be discussed in more detail in connection with FIG. 6. The conductive ball 40 is preferably coated with a highly conductive material which is not readily corrosive, such as gold. Further to minimize the possibility of any minute arcing occurring, the entire space between windows 14 and 15 may be evacuated and filled with an inert gas. When ball 40 is moved into engagement with the contacts 43, a circuit is closed between these contacts and this acts as a switch which, as will be presently explained, is in parallel with switch 32 actuated by button 18.

From the above, it will be apparent that the ball and the contacts 43 form an auxiliary switch which, as will be presently explained, is so connected as to cause the optical display to be energized. This can be done without the use of the other hand and can be done simply by manipulation of the wrist. While initially it may require a certain amount of attention of the wearer to manipulate the ball into the recess provided by the rim 41, the wearer will soon become accustomed to the motion necessary to do this. Because the window 14 is transparent, the wearer can at all times observe the position of the ball and thus readily manipulate it into the recess provided by the rim 41. At the same time, because of the manipulation required to move the ball within the rim 41, the ball will not accidentally move into this position as a result of normal movement of the arm. Furthermore, the movement of the arm required to bring the ball 40 into a position in which it can be moved into the recess within the rim 41 is the normal movement of the arm to bring the watch within viewing position. All that is required in addition to this normal movement is a slight additional manipulation of the arm to get the ball over the edge of the rim 41. As just pointed out, this additional manipulation can be readily accomplished after a certain amount of practice by the wearer.

MODIFICATION OF FIG. 3

Figure 3:
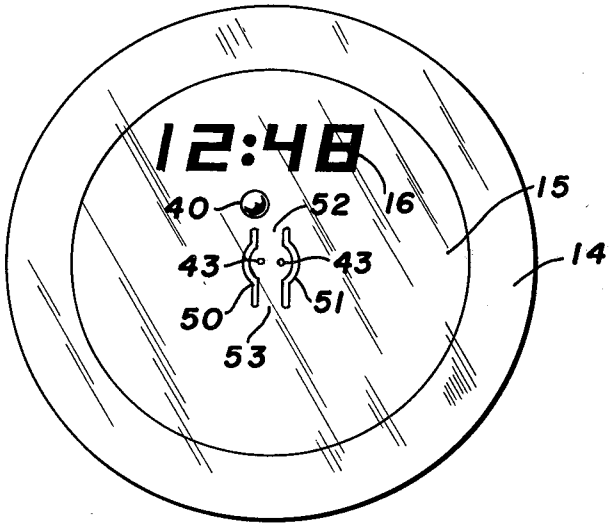
FIG. 3 is a fragmentary plan view of a modification of the invention.

In the modification of FIG. 3, instead of having a circular rim 41, I have provided a pair of curved rims 50 and 51 which at their midpoints are curved with the concave portions of the curves facing each other to outline a portion of a circular recess. Unlike the rim 41, however, the two rims 50 and 51 do not form a closed circular recess and are spaced apart at their opposite ends to provide a pair of entrance throats 52 and 53 which are of a width designed to admit the ball 40 and allow it to pass through. For example, the ball 40 may be introduced into the entrance throat 51. The ball will move into the circular recess defined by the bowed portions of rims 50 and 51 and engage the two contacts 43 thus completing the circuit to the display energization means. Even though the ball 40 may tend to roll on past contacts 43 out through the other throat 53, the display unit will still be energized. The electrical circuitry in digital watches of this type is conventionally designed so as to maintain the display energized for a predetermined period of time, such as 1¼ seconds, even though the read switch has been closed only momentarily. Thus, even a momentary engagement of the ball 40 with the two contacts 43 will cause the display to be energized for a predetermined period of time fixed by the circuitry of the watch.

Again, the arrangement employing the two rims 50 and 51 is one in which the ball 40 is not apt to engage contacts 43 unless the watch is carefully manipulated. Again, because the outer wall 14 is transparent, it is possible at all times to see the position of the ball 40.

MODIFICATION OF FIG. 4

Figure 4:
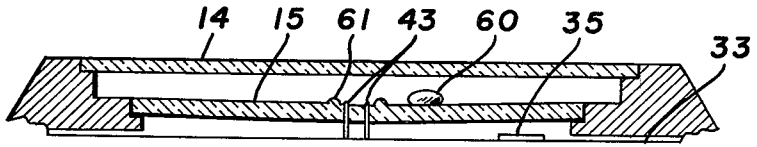
FIG. 4 is a fragmentary sectional view of a further modification.

The modification of FIG. 4 is very similar to that of FIG. 2, the primary exception being that instead of a ball 40, a globule 60 of mercury is employed. Because of the tendency of mercury to "flatten out" somewhat and assume a shape which is somewhat eliptical in cross section, the rim 61 corresponding to rim 41 is of somewhat larger diameter than is rim 41. When the watch is so manipulated that the mercury globule 60 is moved over the edge of the rim 61 into the recess formed by the rim, the mercury will be effective to close the circuit between contacts 43. Where a mercury globule is employed, as in the modification of FIG. 4, it is particularly important that the space between the windows 14 and 15 be evacuated and filled with an inert gas.

MODIFICATION OF FIG. 5

Figure 5:
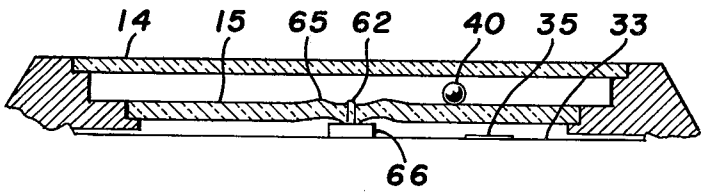
FIG. 5 is a fragmentary sectional view of a still further modification.

The modification of FIG. 5 differs in several respects from that of FIGS. 1 through 4. In the first place, the inner window 15, instead of having a pronounced rim as in the case of FIGS. 2 and 4, has a central portion which gradually slopes upwardly to a high point 64 and then dips towards the center of the window 15. Again, as with the other species, there is a central cavity into which the ball 40 can be placed by suitable manipulation of the wrist.

Another difference between the modification of FIG. 5 and that of FIGS. 1 through 4 is that instead of the ball 40 bridging a pair of contacts, it operates a precision snap switch 66 which has a button 62 projecting through the central portion of the window 15 in such a position that when the ball 40 is introduced into the central recess, the plunger 62 is actuated to close the pair of contacts conventionally provided in such a switch. Inasmuch as the ball 40 no longer acts as a conductive member, it can in this modification be formed of any material having sufficient density to provide the necessary weight for actuation of the plunger 62 of the precision snap switch 66. Also, since the contacts within the switch 66 are protected against the effects of arcing and since the ball 40 in this case has no effect other than that of acting as a weight, it is not necessary in this modification to maintain an inert atmosphere between windows 14 and 15. In fact, due to the fact that the plunger 67 must move through the window 15, it would be difficult to do so unless particular methods were employed for providing a sliding seal.

It is, of course, to be understood that a rim of the type shown in FIGS. 1 and 2 could be employed with the precision snap switch 66. Similarly, the sloping wall arrangement of this modification could be employed with the modification of FIGS. 1 through 4.

CIRCUIT DIAGRAMS OF FIGS. 6 AND 7

Figure 6:
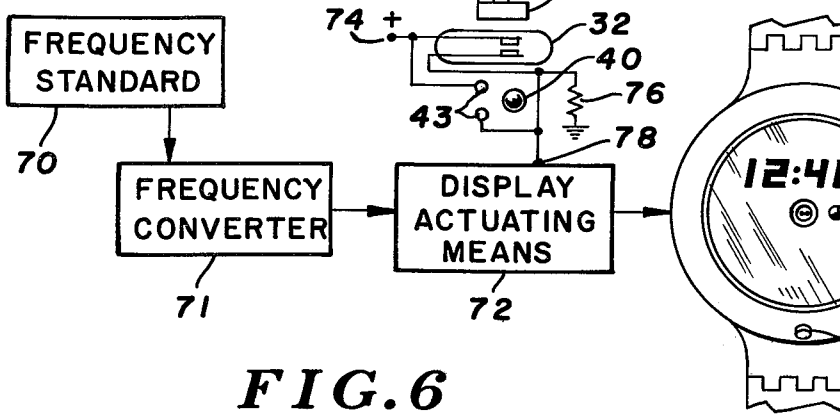
FIG. 6 is a block diagram showing the principal components of the watches of FIGS. 1 through 5.

FIG. 6 is a simplified block diagram of the principal components of the watch 10 of FIGS. 1 and 2. The circuit comprises a frequency standard 70 including a piezoelectric crystal to provide a very accurate frequency. A typical frequency is 32,768 Hz. This relatively high frequency is supplied through a frequency converter 71 in the form of a series of frequency dividers which divide the frequency from the standard 70 so that various output frequencies are obtained including a frequency of 1 Hz. The frequency converter 71 may take any of various forms. One particular form is a series of binary counters from which various frequencies can be obtained. The frequency output of frequency converter 71 is applied to a display actuating means which in turn is connected to the display of watch 10. It is, of course, understood that all of the mechanism so far described is housed within the casing of the watch 10.

Reference has been previously made to the button 18 which is depressed to actuate a reed switch 32 when it is desired to read the time. We have shown this arrangement schematically in FIG. 6. It will be noted that the button 18 is in cooperative relationship with the reed switch 32 having two switch blades which are brought into contact by reason of a magnet 73 associated with push button 18 being moved into proximity with the reed switch 32. When this happens, a circuit is established from a positive terminal 74 through the reed switch 32 to the input terminal 78 of the display actuating means 72. This is effective in a well known manner to cause the display actuating means 72 to turn on the display and allow the time indication to be visible. The input terminal 78 to which switch 32 is connected is normally connected to ground through a resistor 76. Upon switch 32 being closed, a positive voltage is applied to input terminal 78 of the display actuating means from terminal 74.

Connected in parallel with the switch 32 are the contacts 43 of my improved switch. It will be noted that these contacts are shown adjacent to the rolling contact 40 which, when it is maneuvered into a position in which it engages the contacts 43, will result in a circuit being closed therethrough to cause a circuit to be established between the positive terminal 74 and the input terminal 78 of the display actuating means 72.

Figure 7:
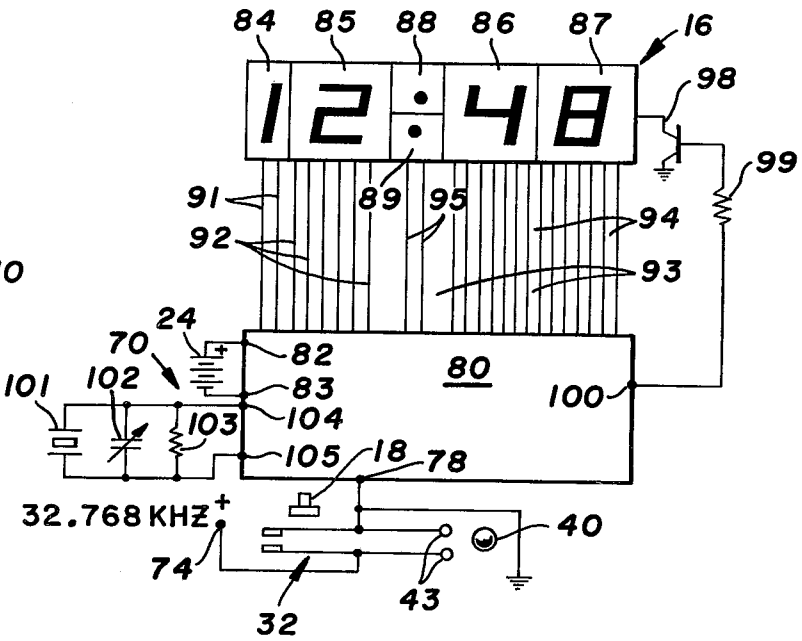
FIG. 7 is a circuit diagram showing schematically the electrical circuit of the wristwatch in somewhat more detail then in FIG. 6.

In FIG. 7, I have shown in schematic form the circuit employed to control the light emitting diodes. The integrated circuit portions of the circuit are indicated by a large block 80. This block is preferably formed of a single chip by large scale integrated circuit techniques. The general circuit for controlling the watch is very old and is shown in numerous patents. A block of the type generally shown designated by the reference numeral 80 is shown in U.S. Pat. No. 3,714,867. Other patents showing similar arrangements are U.S. Pat. Nos. 3,576,099, 3,782,102, and 3,935,701.

The power supply, as previously explained, is in the form of two dry cells 24 which are shown as constituting a battery in the design of FIG. 7. This battery is connected to two input terminals 82 and 83. The time display 16 comprises a plurality of digitial display units 84, 85, 86, 87, 88 and 89. The display units 84 and 85 are used to indicate the hour and the display units 86 and 87 are employed to indicate the minutes. The display units 88 and 89 are employed to display two colon dots. The display unit 84 is in the form of a two bar segment array of light emitting diodes while display units 85, 86 and 87 each have seven light emitting diodes. The reason why unit 84 has only two such units, is that it is never required to display more than the numeral 1 which can be readily formed of two aligned bars. Display units 85, 86 and 87, however, may be called upon to display any number from 2 through 9 and with seven light emitting diodes any of these numerals can be displayed by selectively energizing various diodes. Diplay unit 87 is shown as displaying the numeral 8. It will readily be apparent that all of the other figures can be derived by selectively energizing various of the diodes forming numeral 8. Each of the units 88 and 89 is formed by a single light emitting diode. The selective energization of the various diodes of the light emitting units 84, 85, 86, 87, 88 and 89 is controlled by the integrated circuit of block 80. Extending between block 80 and display unit 84 are two conductors 91, there being one conductor for each of the two light emitting diodes in display unit 84. Similarly, seven conductors 92 extend between the block 80 and the display unit 85. Likewise, seven conductors 93 extend between the block 80 and display unit 86 and seven conductors 94 extend between the block 80 and display unit 87. Two conductors extend between the block 80 and display units 88 and 89, there being one conductor for each of the two display units. The circuitry of the integrated circuit of block 80 is designed to cause selective energization of various bars of the display units to cause various numerical representations indicative of the time as determined by the frequency standard 70. The various displays are also controlled from a PNP transistor 98 which controls the connection of the light emitting diodes to ground. The conductivity of transistor 98 is controlled by a connection to the base of the transistor from terminal 100 of the integrated circuit 80 through resistor 99. When transistor 98 is turned on, display units 84 through 87 are rendered effective. In actual practice, it is customary for the display units to be turned on only for a predetermined period of time such as 1¼ seconds determined by the internal timing mechanism of the circuit 80. After that, the display units are automatically turned off.

Referring to the external units of the frequency standard 70, these are shown in FIG. 7 as comprising a piezoelectric crystal 101, a variable trimming capacitor 102, and a bias resistor 103, these elements being connected to terminals 104 and 105 of block 80. The remaining components of the oscillator are incorporated in the integrated circuit of block 80 is a well known manner. Referring now to the switches which are effective to cause the display units to be turned on, the switch 18, as described in connection with FIG. 6, is effective when pushed in, to close the two contacts of the read switch 32, establishing a circuit from the positive terminal 74 through the switch 32 to the terminal 78. The voltage applied to terminal 78 is in one particular type of watch used to energize display control drivers. In any event, closure of switch 18 will cause the circuit 80 to supply a signal to the base of transistor 98 to turn on the display units for a predetermined period of time such as 1¼ seconds.

Referring noww to the novel switch of the present invention, it will be noted that, as in FIG. 6, the contacts 43 are connected in parallel with the contacts of the switch 32 actuated by push button 18. Hence, when ball 40 is moved into engagement with contacts 43, a circuit will be established from the positive terminal 74 to input terminal 78 of integrated circuit 80 just as though push button 18 were actuated.

CONCLUSION

It will be seen that I have provided a novel watch of the digital type in which the display units are normally maintained deenergized except when it is necessary to read the watch, and in which the watch can be turned on by manipulating a movable element to a predetermined position with respect to the watch face. Furthermore, the position which the watch assumes when the movable element has been manipulated to this position is one which is convenient for reading the watch. While the position in which the movable element causes the display units to be turned on is one which is convenient for reading the watch, the movable element cannot be moved into this predetermined position without deliberate manipulation of the watch to that end. Hence, it is highly unlikely that normal movements of the watch incidental to the daily activity of the wearer will likely cause the watch to be turned on. An important feature of the watch is that the movable element is visible from the front of the watch and it is thus possible to observe its position at all times.

While I have shown certain specific embodiments of my invention, it is to be understood that this is for purposes of illustration only and that the scope of my invention is limited solely by that of the appended claims.

I claim:

1. A wristwatch having an electro-optical time display, means for controlling said time display to cause the latter when energized to display the time,
   a power supply for energizing said time display,
   a case housing said time display, said controlling means and said power supply,
   space inner and outer front walls mounted on said case over said time display,
   and a switch having a pair of contacts secured adjacent said inner wall and which are connected to said power supply and said time display, and a movable member disposed between said inner and outer walls and movable into and out of a cooperative relationship with said contacts and effective to cause said contacts to cause energization of said time display when said movable member is in a predetermined position on said inner front wall,
   said inner front wall being transparent over at least the portion thereof overlying said time display,
   and said outer front wall being transparent over at least the portions overlying said time display and the possible area of movement of said movable member so that the wearer can not only read the time indicated by said optical display but can also be aware of the position of said movable member with respect to said predetermined position.

2. The wristwatch of claim 1 in which the movable member is a switch contact and said pair of contacts are spaced contacts adapted to be electrically bridged by said movable member when said movable member is in said predetermined position on said inner wall.

3. The wristwatch of claim 1 in which the movable member is a conductive ball which rolls on said inner wall.

4. The wristwatch of claim 1 in which the elevation of said inner wall adjacent said predetermined position when said inner wall is in a generally horizontal position is sufficiently high that said movable member will not normally move to said predetermined position without deliberate manipulation of said watch for that purpose.

5. The wristwatch of claim 1 in which there is a recess at said predetermined position in which said movable member tends to remain when manipulated into said recess.

6. The wristwatch of claim 1 in which said inner and outer walls are sealed to said case and collectively form the front closure of said case.

7. The wristwatch of claim 1 in which said inner front wall has a barrier at least partially surrounding said predetermined position so that said movable member must be manipulated with respect to said barrier in order to move it to said predetermined position.

8. The wristwatch of claim 7 in which said barrier is a ridge having an opening therein of a size to allow the passage of said movable member through said opening.

9. A wristwatch having an electro-optical time display, means for controlling said time display to cause the latter when energized to display the time,
   a power supply for energizing said time display,
   a case housing said time display, said controlling means and said power supply,
   spaced inner and outer front walls mounted on said case over said time display,
   and a switch having a pair of contacts secured adjacent said inner wall and which are connected to said power supply and said time display, and a movable member disposed between said inner and outer walls and movable into and out of a cooperative relationship with said contacts and effective to cause said contacts to cause energization of said time display when said movble member is in a predetermined position on said inner front wall,
   the elevation of said inner wall when said inner wall is in a generally horizontal position being sufficiently high that said movable member will not normally move to said predetermined position without deliberate manipulation of said watch for that purpose, and
   said inner and outer front walls being transparent over at least the portions thereof overlying said time display.

10. The wristwatch of claim 9 in which the movable member is a ball and in which the slope of the inner wall adjacent said predetermined position is such that said ball will not normally roll to said predetermined position without deliberate manipulation of said watch.

* * * * *